United States Patent [19]

Deutsch

[11] Patent Number: 4,998,494

[45] Date of Patent: Mar. 12, 1991

[54] DEVICE FOR ENHANCING THE BUOYANCY OF SAILBOARDS AND THE LIKE

[76] Inventor: Reinhard Deutsch, wohnhaft in Gräfstrasse 47, D-600 Frankfurt/Main, Fed. Rep. of Germany

[21] Appl. No.: 474,513

[22] Filed: Feb. 2, 1990

[30] Foreign Application Priority Data

Feb. 15, 1989 [DE] Fed. Rep. of Germany ..... 3904540

[51] Int. Cl.[5] ..... B63H 9/08

[52] U.S. Cl. ..... 114/39.2; 114/123

[58] Field of Search ..... 114/39.1, 39.2, 219, 114/345, 123; 441/74, 66

[56] References Cited

U.S. PATENT DOCUMENTS

| | | | |
|---|---|---|---|
| 3,657,753 | 4/1972 | LeBlanc, Sr. | 441/66 |
| 4,458,859 | 7/1984 | Ganev | 114/39.2 |
| 4,598,659 | 7/1986 | Chinnery | 114/39.2 |

FOREIGN PATENT DOCUMENTS 8322936.1 11/1983 Fed. Rep. of Germany .

*Primary Examiner*—Joseph F. Peters, Jr.
*Assistant Examiner*—Jesûs D. Sotelo
*Attorney, Agent, or Firm*—Peter K. Kontler

[57] ABSTRACT

The bow portion of a sailbaord is insertable into a pocket at the underside of an inflatable delta-shaped hull having a width exceeding that of the sailboard. This results in a boat which is capable of supporting several persons. The stern portion of the sailbaord can be strapped to the stern of the hull if friction between the surface surrounding the pocket and the surface of inserted bow portion of the sailboard does not suffice to reliably couple the sailboard to the hull. The hull is assembled of or includes several longitudinally extending tubes defining gas-receiving chambers or serving to receive inflatable inner tubes. The hull can be provided with openings for a mast, which can be rigged to the hull, and for a pivotable keel of the sailboard. The hull can also carry a delta wing and an engine for an airscrew if the combination of hull and sailboard is to be used as part of an ultralight aircraft.

23 Claims, 1 Drawing Sheet

DEVICE FOR ENHANCING THE BUOYANCY OF SAILBOARDS AND THE LIKE

BACKGROUND OF THE INVENTION

The invention relates to boats in general, and more particularly to improvements in devices for enhancing the buoyancy of sailboards, surfboards and analogous floatable vessels.

German Utility Model No. G 83 22 936.1 of North Sails Surf Antilles N.V. discloses a device which is intended to enhance the stability and the buoyancy of a sailboard or surfboard (hereinafter called sailboard). The device of this Utility Model consists essentially of inflatable tubes which are attached to and surround the edges of the sailboard. The publication further proposes to place an air-filled buoyancy enhancing tube hose or a like part adjacent the upper side of the sailboard. The tubes are affixed to the sailboard by straps or are configurated to hug portions of the external surface of the sailboard. An advantage of the device which is described and shown in this publication is that it can be collapsed into a relatively small package for the purposes of storage and transport. However, the device also exhibits a serious drawback, namely that it does not contribute (or does not contribute significantly) to the comfort and space requirements of the occupant or occupants. Therefore, this device cannot be used to convert a relatively small sailboard into a boat which is ready to be occupied by several persons. Moreover, the attachment of such device to a sailboard takes up a considerable amount of time, and the attached device does not contribute to the ability of the sailboard to rely on the propelling force of air.

OBJECTS OF THE INVENTION

An object of the invention is to provide a device which not only enhances the buoyancy of a sailboard or a like floatable contrivance but can also increase the capacity of the resulting vessel.

Another object of the invention is to provide a simple, compact and inexpensive device which can be used in conjunction with existing sailboards, surfboards and like floatable bodies.

A further object of the invention is to provide a device which not only enhances the buoyancy of a sailboard or a like body but also reduces the likelihood of excessive listing or overturning of the sailboard.

An additional object of the invention is to provide a device which can be used to convert a sailboard or a like floatable object into an airplane.

Still another object of the invention is to provide a device which can be attached to existing sailboards without the need for a positive or permanent connection between its component parts and the board.

Another object of the invention is to provide a novel and improved method of enhancing the buoyancy and stability of sailboards and analogous floatable objects.

A further object of the invention is to provide a novel and improved sailboat.

An additional object of the invention is to provide a novel and improved ultralight aircraft.

SUMMARY OF THE INVENTION

The invention is embodied in a device for enhancing the buoyancy of a sailboard or surfboard (hereinafter called sailboard) of the type having a bow portion, a stern portion, an upper side an underside and a predetermined width. The improved device comprises an inflatable and collapsible (deflatable) preferably substantially delta-shaped hull having a bow, a stern, a width exceeding the predetermined width, an upper side, an underside and a pocket at the underside for reception of at least the bow portion of the sailboard. The pocket has a front portion at the bow, and the capacity of the pocket is such as to reliably retain the bow portion of the sailboard by friction in response to inflation of the hull, i.e., it is not absolutely necessary to positively couple or to permanently affix the sailboard to the hull. When inflated, the hull can constitute an airfoil.

If the sailboard has a keel which extends from its underside and is spaced apart from its bow portion, the location of the inlet of the pocket at the underside of the hull is preferably selected (between the stern and the bow of the hull) in such a way that the keel of the sailboard having its bow portion in the pocket is located between the inlet of the pocket and the stern of the hull, i.e., outside of and behind the pocket.

The device can further comprise means for separably coupling the hull with the stern portion of a sailboard, the bow portion of which is confined in the pocket. Such coupling means can comprise at least one strap provided on the sailboard and engageable with the stern of the hull or vice versa.

If the keel of the sailboard is pivotable or otherwise movable from the underside to the upper side of the sailboard, the hull can be provided with an opening for the keel of the sailboard the bow portion of which is confined in the pocket.

If the sailboard is equippped with a mast extending from its upper side, the hull is preferably provided with an opening so that the mast of a sailboard having its bow portion in the pocket extends through and upwardly beyond the opening.

The trailing edge of the preferably substantially delta-shaped hull preferably includes forwardly sloping portions. The two marginal portions of the hull (namely the portions which define the edges of the hull between the bow and the trailing edge) can constitute one or more inflatable tubes. Furthermore, the hull can be formed with tubes which define chambers and are disposed between the two marginal portions and extend substantially from the bow toward the trailing edge of the hull. Such hull includes panels and walls or partitions which latter separate the chambers from each other. The panels and walls of the hull can consist of fluidtight flexible material and can be bonded (e.g., welded or glued) to each other. If desired, the panels and walls can be made of canvas and the chambers of the tubes can receive inflatable inner tubes consisting of rubber or the like. Alternatively, the panels and the walls can include flexible substrates of canvas or the like and coats of sealing material (such as polyvinyl chloride) on the substrates.

The panels of the hull can include arcuate portions having convex outer sides and being adjacent the upper side and the underside of the hull. Such hull can further comprise a covering which overlies the arcuate portions at the underside and/or at the upper side of the hull.

If the sailboard has a mast which extends upwardly through an opening of the hull while the bow portion of the sailboard is confined in the pocket at the underside of the hull, the latter can further comprise means for releasably rigging the mast to the hull; such rigging means can include eyelets affixed to the hull and/or to the mast and cables, wires and/or ropes between the eyelets.

If the stern portion of the sailboard is provided with a preferably adjustable fin which extends downwardly from the underside at the stern portion of the sailboard, the fin is adjacent the stern of the hull when the bow portion of the sailboard is properly received in the pocket.

One or more preferably (but not necessarily) inflatable cushions can be furnished with the hull to be separably or permanently connected to the upper side of the hull and to serve as body rests, splash guards and/or other utilitarian or decorative purposes.

The stern of the hull can be provided with a plate or another suitable support for an engine and/or for a rudder. The engine can drive an airscrew. Such engine and the airscrew can form part of a socalled ultralight aircraft (also called microlight) which further includes a suitable wing connected to or connectable with the hull.

The novel features which are considered as characteristic of the invention are set forth in particular in the appended claims. The improved device itself, however, both as to its construction and the mode of using the same, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
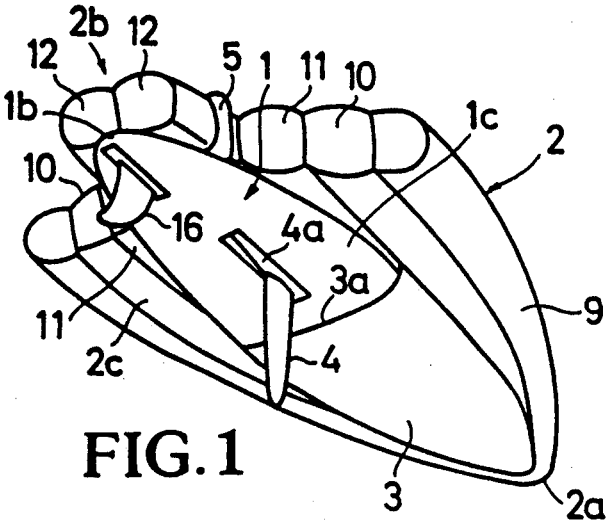
FIG. 1 is a perspective view showing the underside of an inflated hull and of a sailboard having its bow portion confined in the pocket at the underside of the hull.

The structure which is shown in FIGS. 1 to 4 comprises a sailboard 1 having a bow portion 1*a*, a stern portion 1*b*, an underside 1*c*, an upper side 1*d*, a keel 4 which extends from its underside 1*c* but can be pivoted to extend upwardly and beyond the upper side 1*d*, and a fin 16 which extends from the underside 1*c* in the region of the stern portion 1*b*. The structure of FIGS. 1 to 4 further comprises a delta-shaped hull 2 (shown in inflated condition) having a bow 2*a*, a stern 2*b* an underside 2*c* provided with a pocket 3, an upper side 2*e* and a trailing edge 2*d*. The inlet 3*a* of the pocket 3 is located between the bow 2*a* and the stern 2*b*, and this pocket serves to receive at least the bow portion 1*a* of the sailboard 1. The volume or capacity of the pocket 3 is selected in such a way that the bow portion 1*a* of the sailboard 1 is reliably held therein by friction when the hull 2 is inflated. The width W of the sailboard 1 is considerably less than the width WW of the inflated hull 2; for example, the width of the inflated hull 2 can be approximately three times the width of the sailboard 1.

When the bow portion 1*a* is received in the pocket 3, the keel 4 of the sailboard 1 is or can be closely adjacent the inlet 3*a*. Such depth of the pocket 3 ensures that the keel 4 can be pivoted to and from the operative position of FIG. 1 while the bow portion 1*a* is confined in and is frictionally held by the surface bounding the pocket 3.

In order to even further reduce the likelihood of accidental or unintentional separation of the hull 2 from the inserted sailboard 1, the hull is or can be provided with coupling means including one or more flexible straps 5 (shown only in FIG. 1) which can be introduced into and through one or more foot-receiving eyelets or like parts (not specifically shown) at the stern portion 1*a* of the sailboard 1 behind the keel 4. The strap or straps 5 can constitute separate parts which are threaded through one or more hoops, loops or eyelets at the upper side of the stern portion 1*b* and are draped the stern 2*b* of the inflated hull 2. This ensures that the stern portion 1*b* of the properly inserted and tied sailboard 1 remains unchanged, when in contact with water.

Figure 2:
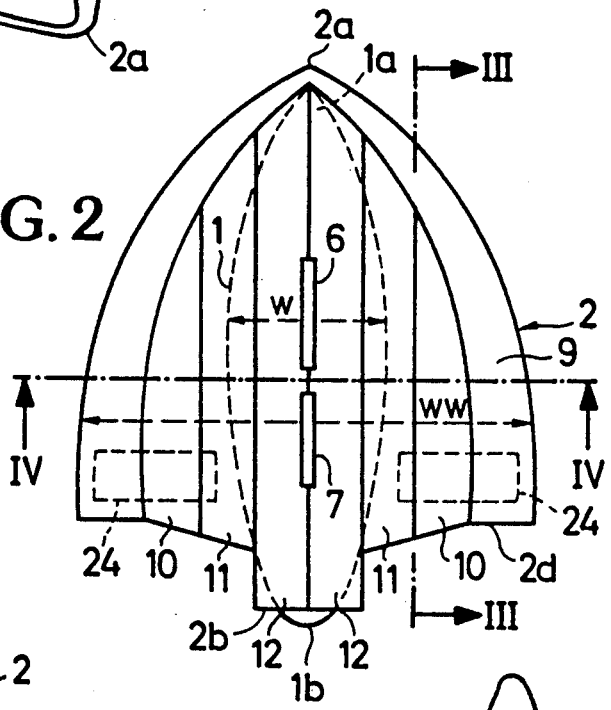
FIG. 2 is a plan view of the structure which is shown in FIG. 1.

FIG. 2 shows that the hull 2 is provided with aligned centrally located openings 6 and 7. The rear opening 7 provides room for pivoting of the keel 4 from the underside 1*c* toward and beyond the upper side 1*d* of the sailboard 1 while the bow portion 1*a* of such sailboard extends into and is held in the pocket 3. The front opening 6 provides room for the lower portion of a mast 8 (FIG. 4) which is or can be affixed to and then extends from the upper side 1*d* of the sailboard 1. The reference character 15 denotes a suitable rigging which secures the mast 8 to the inflated hull 2. The illustrated rigging 15 comprises eyelets secured to the hull 2, eyelets secured to a median portion of the mast 8, and cables, ropes or wires extending from the eyelets of the mast to the eyelets of the hull. The surfaces bounding the opening 6 conform to the peripheral surface of the adjacent portion of the mast 8 when the hull 2 is inflated while the mast is affixed to and extends upwardly from the sailboard 1. The same holds true for the surfaces bounding the rear opening 7, i.e., such surfaces closely follow the outline of the keel 4 when the latter extends upwardly and beyond the upper side 1*d* of the sailboard 1. The openings 6 and 7 are closed when the hull 2 is inflated, when the mast 8 is detached and when the keel 4 extends downwardly beyond the underside 1*c* of the sailboard 1.

The rear edge 2*d* of the inflated hull 2 has forwardly sloping portions; its rearmost portion is located in the middle and is adjacent the stern portion 1*b* of the properly installed sailboard 1. FIG. 2 shows that the openings 6 and 7 are located in or close to the common central longitudinal vertical symmetry plane of the sailboard 1 and hull 2.

The marginal portions of the hull 2 are constituted by a single deformable and inflatable tube 9 or by two mirror symmetrical tubes each of which extends from the bow 2*a* to the trailing edge 2*d*.

The two halves of a single tube 9 or the two discrete tubes 9 flank a set of three pairs of tubes 10, 11 and 12 all of which extend in a direction from the bow 2*a* toward the trailing edge 2*d*. The two centrally located tubes 12 are longer than the neighboring tubes 11, and the tubes 11 are longer than the neighboring tubes 10. In other words, the length of tubes increases in a direction from the marginal portions (tube or tubes 9) toward the center of the hull 2.

Figure 3:
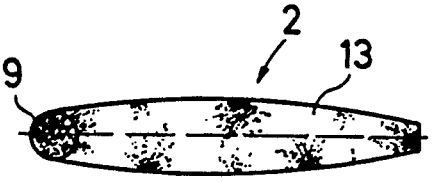
FIG. 3 is a sectional view substantially as seen in the direction of arrows from the line III—III of FIG. 2.

The chambers in the tubes 9, 10, 11 and 12 are separated from each other by partitions or walls 13 one of which is shown in FIG. 3. FIG. 3 further shows that a section taken through the hull 2 in a plane which is parallel to the central symmetry plane resembles an airfoil.

The hull 2 can include panels of fluidtight material, such as impregnated canvas or the like, which are adhesively connected, welded or otherwise bonded to each other and to the walls 13. Any material which is suitable for the making of inflatable boats or the like can be used to make the hull 2. The latter can be provided with one or more valves to permit inflation by an air pump, a compressor a bottle of compressed gas or any other source of compressed air. If desired, the compartments or chambers which are defined by the panels and walls 13 can receive, inflatable tubes 22 (one shown in one of the tubes 10 of FIG. 4). This renders it possible to maintain the assembly of sailboard 1 and hull 2 afloat even if the panels and/or the walls 13 of the hull develop one or more holes. For example, the panels and the walls 13 of the hull 2 can be made of a substrate of textile material provided with an inner and/or an outer coat of polyvinyl chloride or other plastic material which renders the substrate impermeable to water. The panels and the walls 13 of the hull 2 need not be impermeable to water if the hull contains a set of inflatable tubes 22.

The arcuate (concavo-convex) sections of the tubes 9 to 12 at the upper side 2*e* of the inflated hull 2 are overlapped by a covering 14 of flexible material. Such covering 14 can form part of an envelope which also confines at least a portion of the underside 2*c* of the hull. An advantage of the covering 14 is that it enhances the smoothness of the upper side 2*e* and renders the boat (including the hull 2 and the sailboard 1) more comfortable to the occupant or occupants. In addition, the covering 14 enhances the stability of the hull 2.

Figure 4:
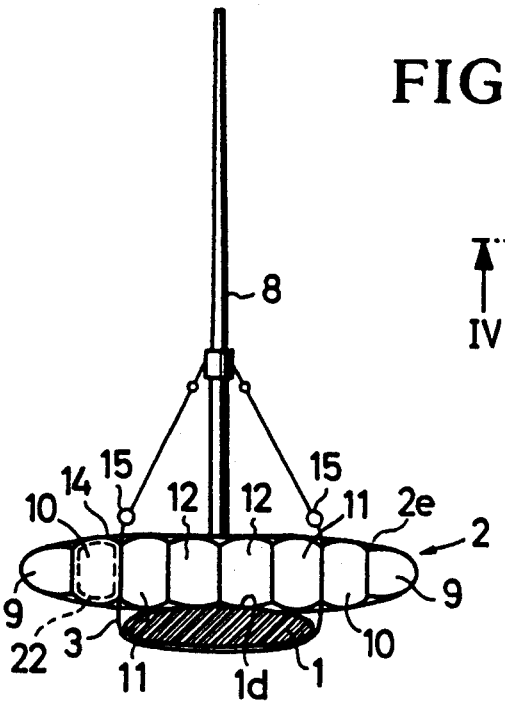
FIG. 4 is a sectional view substantially as seen in the direction of arrows from the line IV—IV of FIG. 2, and further showing a mast and the rigging which secures the mast to the hull.

The mast 8 can be supported in erected position as shown in FIG. 4 or in horizontal position. In each of its positions, the mast 8 can be secured to the hull 2 by the aforediscussed rigging 15. Those eyelets of the rigging 15 which are secured to the hull 2 can be attached to the panels of the hull by threads, clamps or in any other suitable way. The rigging 15 is preferably designed in such a manner that it is capable of transmitting forces to the pocket 3 and hence to the sailboard 1 in the pocket. This reduces the likelihood of listing or heeling of the boat including the hull 2 and the sailboard 1.

Figure 5:
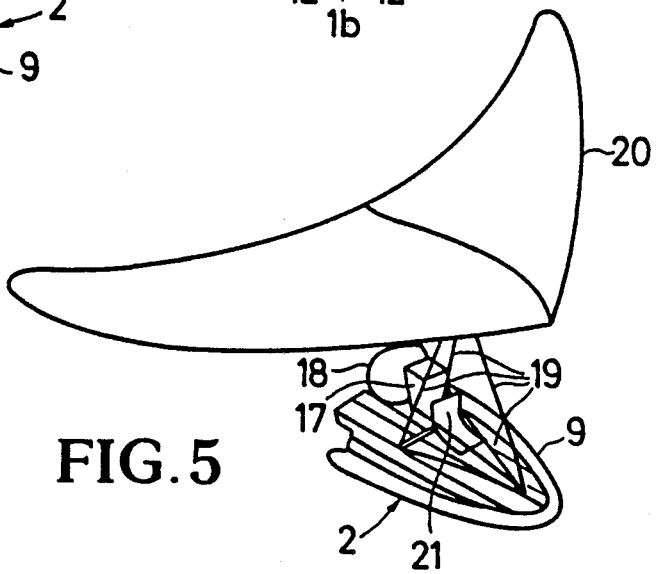
FIG. 5 is a perspective view of an ultralight aircraft which embodies the structure of FIG. 1.

An engine 17 which serves to drive an airscrew 18 is fixed to a frame 19. The fin 16 of the sailboard 1 is preferably adjustable to enhance the maneuverability of the boat. In lieu of driving the airscrew 18, the engine 17 or another engine supported on the stern 2*b* of the hull 2 by means of a support (not shown) can be used to drive a propeller which extends into the body of water behind the hull 2. The front portion of the inflated hull 2 can carry the frame 19 which also carries a delta-shaped wing 20 of the type used in ultralight aircraft (also known as microlights). This renders it possible to use the structure of FIG. 5 as a flying boat having a composite hull including the inflatable hull 2 and the sailboard 1. The reference character 21 denotes a seat for the operator of the craft.

FIG. 2 shows by broken lines two inflatable or permanently inflated cushions 24 which can be tied to and can be readily detached from the inflated hull 2. The purpose of the cushions 24 is to serve as beach chairs, as splash guards, as seats, as arm rests or any other useful and/or decorative purpose. Each of the cushions 24 can constitute a length of inflatable tube. For example, such cushions can be used with advantage when the mast 8 is erected and carries one or more sails, i.e., when the improved structure is used as a sailboat.

The dimensions of the inflated hull 2 can be selected in such a way that it can comfortably accommodate at least two adult persons. All that is necessary to convert a relatively narrow sailboard 1 into a relatively large boat is to introduce the bow portion 1*a* into the pocket 3 and to inflate the hull 2. Since the hull 2 is relatively wide, the boat including this hull and the sailboard 1 is stable in water and provides room for two or more persons irrespective of whether the occupants select to stand or lie down on top of the covering 14. When not in use, the deflated hull 2 occupies a small amount of space which is desirable and convenient for transport and storage. The sailboard 1 can be tied to the roof of an automobile, and the collapsed hull 2 can be confined in the trunk or elsewhere in or on the same vehicle. The aerodynamic shape of the inflated hull 2 enhances its appearance and is useful when the hull is used on water or as a component part of an aircraft.

The illustrated pocket 3 can be replaced with a much deeper pocket, e.g., a pocket which can confine at least the major portion of the sailboard 1. The illustrated relatively shallow pocket 3 suffices if the hull 2 and/or the sailboard 1 is provided with coupling means (such as the coupling means including the strap or straps 5) for securing the stern portion 1*b* to the stern 2. The straps 5 can be introduced through foot-receiving hoops or eyelets of the type customarily provided on sailboards, i.e., such conventional hoops can be used as part of means for coupling the sailboard 1 to the inflated hull 2. The arrangement may be such that the stern portion 2*b* of the inflated hull 2 overlies standard hoops at the stern portion 1*b* of the properly installed sailboard 1; this ensures that the stern 2*b* is spaced apart from and is located above the stern portion 1*b* of the sailboard. An advantage of such mounting of the stern 2*b* at a level above the hoops at the stern portion 1*b* is that the stern 2*b* does not contact the water or is in minimal or negligible contact with water when the boat is driven (by sails and/or by an airscrew and/or by a propeller) at an elevated speed.

An advantage of the opening 6 is that the mast 8 can be erected (or can remain erected) while the bow portion 1*a* of the sailboard 1 extends into the pocket 3. The opening 7 is optional but desirable because it permits a pivoting of the keel 4 to a position in which it extends through the opening 7 and above the upper side 2*e* of the inflated hull 2.

The delta shape of the inflated hull 2 ensures that the boat including the hull and a sailboard 1 encounters little resistance to forward movement in water. In addition, a delta-shaped hull exhibits the advantage that it enhances the movements of the boat in water and also contributes to the aerodynamic lift when the boat advances at an elevated speed and is supported by water as well as by air, especially when the weight of the boat is carried predominantly by air. This enables the boat to advance at a very high speed.

The inflated hull 2 enables the sailboard 1 to carry out much longer and higher jumps because the combination of inflated hull and properly installed sailboard 1 constitutes an aerodynamic airfoil.

The feature that the hull 2 is or can be assembled of several sets of tubes contributes to its simplicity and renders it possible to impart to the hull a desired optimum configuration, particularly that of a delta wing.

The tube or tubes 9 can be said to serve as bumpers as well as a means for protecting and confining the tubes 10, 11 and 12. The configuration which is shown in FIG. 3 also contributes to the aerodynamic lift when the boat including the hull 2 and the sailboard 1 is used on water or in the air.

As mentioned above, the inflatable tubes 22 constitute an optional feature of the improved hull. They are desirable and advantageous because any damage to the panels and walls 13 of the hull 2 is less likely to lead to sinking or listing of the boat even if the covering 14 supports a relatively large number of persons.

The stern **2*b* can carry by means of a support (not shown) a rudder (not shown) which can be used in lieu of or in addition to the fin 16. A rudder and/or a fin is desirable because it promotes the directional stability of the craft in actual use. The engine 17 can drive the airscrew 18 or a propeller when the mast 8 is removed or when the sails do not suffice to propel the boat at a desired speed. The mast 8 is removed or is affixed to the hull 2** in horizontal position when the boat is used as a component part of an ultralight aircraft which is to take off from or to land on water.

If the hull 2 is provided with a single valve for admission of compressed air or another gas, the internal spaces of the tubes 9, 10, 11 and 12 communicate with each other by way of one or more openings. Alternatively, the hull can be provided with two or more valves, for example, with a discrete valve for each of the tubes 9 to 12. If the tubes contain inflatable tubes 22, each such tube can be provided with its own gas-admitting valve. As mentioned above, the panels of the hull 2 need not even be impermeable to fluids if the hull comprises discrete inflatable tubes 22. For example, the entire hull 2 can be made of canvas which forms the tubes 9 to 12, and each of these tubes receives an inflatable tube 22. If the tubes 22 are not used, the panels and partitions or walls 13 of the hull are made of a material which is impermeable to fluids so that the tubes can be inflated and can prevent escape of admitted gaseous fluid.

The keel 4 is preferably mounted on a narrow flap **4*a* which can be seen in FIG. 1 and is pivotable relative to the sailboard 1 between the position of FIG. 1 and a position in which the keel extends upwardly through and beyond the opening 7. This is desirable when the sailboard 1 or the boat including the sailboard and the hull 2** is used in shallow water, i.e., when the tip of the keel would be likely to hit the ground.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A device for enhancing the buoyancy of a sailboard of the type having a bow portion, a stern portion and a predetermined width, said device comprising an inflatable and collapsible hull having a bow, a stern, a width exceeding said predetermined width, an underside and a pocket at said underside for at least the bow portion of the sailboard, said pocket having a front portion at said bow and having a capacity such as to retain the bow portion of the sailboard in response to inflation of the hull.

2. The device of claim 1, wherein said hull is shaped as a wing in the inflated condition thereof.

3. The device of claim 1 for enhancing the buoyancy of a sailboard having an underside and a keel disposed at the underside thereof and spaced apart from the bow portion, wherein said pocket has an inlet intermediate said stern and said bow at a distance from the bow such that the keel of the sailboard having its bow portion in said pocket is located between said inlet and said stern.

4. The device of claim 1, further comprising means for separably coupling to said hull the stern portion of a sailboard having its bow portion in said pocket.

5. The device of claim 4, wherein said coupling means comprises at least one strap provided on the sailboard and engageable with the stern of said hull.

6. The device of claim 1 for enhancing the buoyancy of a sailboard having an underside and a keel at the underside thereof, wherein said hull has an opening for the keel of said sailboard having its bow portion in said pocket.

7. The device of claim 1 for enhancing the buoyancy of a sailboard having an upper side and a mast extending from the upper side, wherein said hull has an opening for the mast of said sailboard having its bow portion in said pocket.

8. The device of claim 1, wherein said hull is delta shaped and has a trailing edge disposed at said stern and including forwardly sloping portions.

9. The device of claim 1, wherein said hull has a trailing edge at said stern and includes marginal portions including an inflatable tube extending from said bow to said trailing edge.

10. The device of claim 9, wherein said hull has tubes disposed between said marginal portions and extending substantially from said bow toward said trailing edge.

11. The device of claim 10, wherein said hull includes walls between said tubes.

12. The device of claim 1, wherein said hull has panels and walls which consist of fluidtight flexible material and are bonded to each other.

13. The device of claim 1, wherein said hull includes panels and walls consisting of canvas and defining a plurality of chambers, and inflatable inner tubes in said chambers.

14. The device of claim 1, wherein said hull includes panels and walls having deformable substrates and coats of sealing material on said substrates, said panels and walls defining chambers and said hull further including inflatable inner tubes in said chambers.

15. The device of claim 14, wherein said coats contain polyvinyl chloride.

16. The device of claim 1, wherein said hull includes panels and walls defining a plurality of neighboring chambers, said panels having arcuate portions adjacent said upper side and said underside, and said hull further including a covering overlying the arcuate portions of said panels at least at one side of said hull.

17. The device of claim 1 for enhancing the buoyancy of a sailboard having a mast which extends upwardly through said hull when the bow portion of such sailboard is received in said pocket, further comprising means for releasably rigging the mast to said hull.

18. The device of claim 1, wherein said hull includes a support and further comprising an engine on said support.

19. The device of claim 1, wherein said stern carries a rudder.

20. The device of claim 1 for enhancing the buoyancy of a sailboard having an adjustable fin at the stern portion thereof, wherein said stern is adjacent the fin of the sailboard having the bow portion in said pocket.

21. The device of claim 1, wherein said hull has an upper side and further comprising at least one cushion connected to and disposed at the upper side of said hull.

22. The device of claim 1, further comprising an engine provided on said hull and an airscrew driven by said engine.

23. The device of claim 1, wherein said hull forms part of an ultralight aircraft including a wing and an engine on said hull.

* * * * *